United States Patent [19]

Stalder et al.

[11] Patent Number: 5,038,553

[45] Date of Patent: Aug. 13, 1991

[54] DRAFTING ARRANGEMENT FOR FALSE TWIST SPINNING

[75] Inventors: Herbert Stalder, Kollbrunn; Emil Briner, Winterthur, both of Switzerland

[73] Assignee: Rieter Machine Works, Ltd., Winterthur, Switzerland

[21] Appl. No.: 412,094

[22] Filed: Sep. 25, 1989

[30] Foreign Application Priority Data

Sep. 29, 1988 [CH] Switzerland ..... 03623/88

[51] Int. Cl.[5] ..... D01H 5/00

[52] U.S. Cl. ..... 57/97; 57/315; 57/328; 19/236; 19/258

[58] Field of Search ..... 19/236, 244, 258, 259, 19/286, 287; 57/315, 328, 97

[56] References Cited

U.S. PATENT DOCUMENTS

| | | | |
|---|---|---|---|
| 2,112,095 | 3/1938 | Hoffmann | 19/236 |
| 2,199,842 | 5/1940 | Schlums | 19/130 |
| 3,006,037 | 10/1961 | Bettolo | 19/258 |
| 3,027,603 | 4/1962 | Mason | 19/258 |
| 3,070,848 | 1/1963 | König | 19/236 |
| 3,078,519 | 2/1963 | Angioletti | 19/258 |
| 4,484,433 | 11/1984 | Stahlecker et al. | 57/315 X |
| 4,495,761 | 1/1985 | Nakayama et al. | 57/315 X |
| 4,565,063 | 1/1986 | Stalder et al. | 57/328 |
| 4,718,225 | 1/1988 | Sanagi | 57/328 |
| 4,823,545 | 4/1989 | Flueckiger | 57/328 |

FOREIGN PATENT DOCUMENTS

| | | |
|---|---|---|
| 3128870 | 2/1983 | Fed. Rep. of Germany . |
| 3236971 | 4/1983 | Fed. Rep. of Germany . |
| 3248390 | 7/1983 | Fed. Rep. of Germany . |
| 3437343 | 5/1985 | Fed. Rep. of Germany . |
| 3345170 | 6/1985 | Fed. Rep. of Germany . |
| 1041854 | 9/1966 | United Kingdom . |

*Primary Examiner*—Stuart S. Levy
*Assistant Examiner*—Steven M. duBois
*Attorney, Agent, or Firm*—Kenyon & Kenyon

[57] ABSTRACT

The delivery roller pair are made with continuous uninterrupted cylindrical surfaces so that air flows on the input side converge in the nip and then flow from the central zone thereof to opposite end zones. In addition, the air flows on the output side flow from the end zones towards the central zone. The suction nozzle is disposed downstream and in alignment with the nip so as to receive the fiber material for spinning into yarn.

13 Claims, 2 Drawing Sheets

Fig. 1
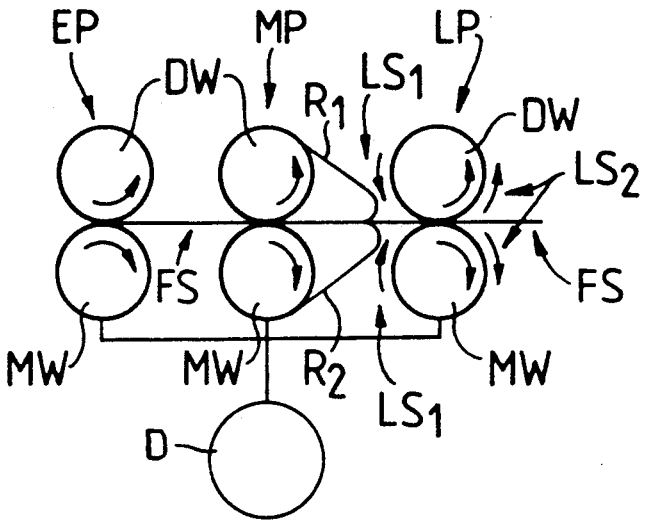
Fig. 2
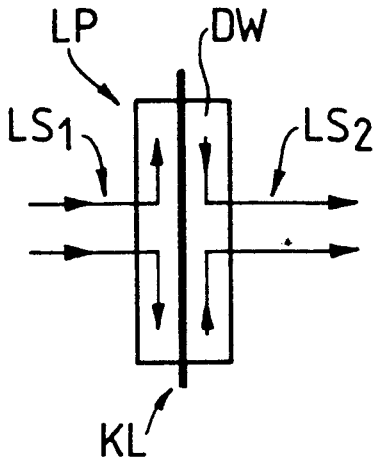
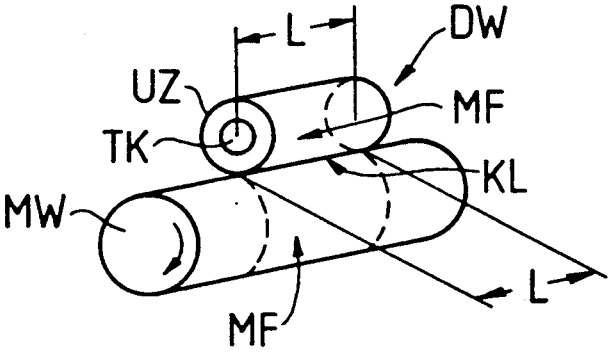
Fig. 3
Fig. 4
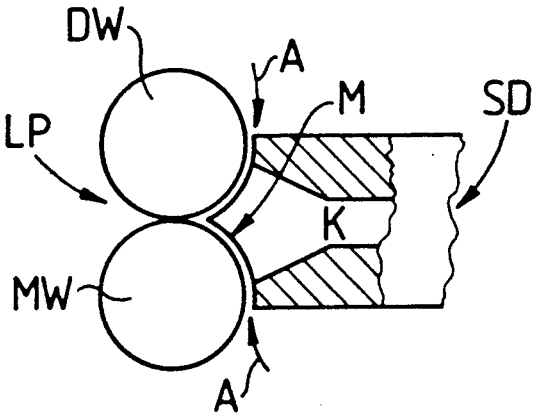
Fig. 5
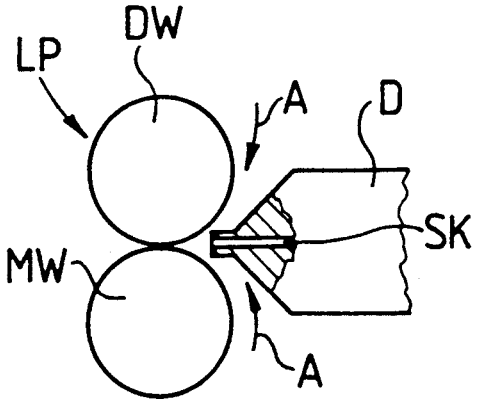

DRAFTING ARRANGEMENT FOR FALSE TWIST SPINNING

This invention relates to a drafting arrangement for false twist spinning. More particularly, this invention relates to a delivery roller pair for a drafting arrangement in a false twist spinning machine.

As is known, the delivery roller pair of a drafting arrangement for fiber material must comply with very stringent requirements. The delivery rollers are the fastest running rollers of all the rollers of a drafting arrangement and the nip thereof may define a boundary of the final drafting zone of the complete arrangement. On the output side, the delivery roller pair delivers the fibers for spinning to the so-called spinning triangle where they are twisted together. The circumstances around the delivery roller pair have a major effect on yarn quality.

The delivery roller pair is also subject to fibers sticking to the rollers, which may lead to coiling.

The foregoing applies to drafting arrangements both for conventional spinning (ring spinning) and for more modern spinning processes (false twist spinning, more particularly jet spinning). Another consideration so far as modern spinning processes are concerned is that the delivery speed of up to 300 m/min is very much higher than in conventional spinning and the drafts used are very high—more than 100-fold. The resulting air flows near the front roller pair may thus have a decisive effect on the fiber movements on the roller pair.

Even in the early history of false twist spinning, concepts were put forward about air flows near the delivery roller pair, as can be gathered from U.S. Pat. No. 3,487,619 which suggests providing the bottom roll with air passages so that the air flow on the input side of the delivery roller pair can pass to the output side thereof through such passages. In this event, however, the fiber guiding zone of the bottom roller would have to be formed with apertures. This is almost certainly why these arrangements have not become established in practice.

A normal fluted delivery roller permits some air to pass from the input side to the output side of the delivery roller pair, but the amount of air thus passing is insufficient to produce the required effect.

There has recently been a new approach to the same problem, as can be gathered from U.S. Pat. No. 4,718,225. In this case, the bottom roller or top roller or indeed both rollers can have circumferential air passages disposed laterally of the fiber-guiding zone of the delivery roller pair. In the latter zone itself, the rollers have "smooth opposed uninterrupted nip surfaces for moving a bunch of fibers". An arrangement of this kind is known per se from U.S. Pat. No. 2,244,461. However, in such a construction, both air streams around the delivery roller pair and the tendency of the fibers to stick to the rollers remain and, as in the past, may be regarded as problems.

In false twist (more particularly jet) spinning, the drafting arrangement plays a very important role because the drafting arrangement must not only reduce the sliver but also divide the sliver in order to prepare the so-called wrap fibers. In conventional theory, the wrap fibers are often referred to as "edge fibers", on the assumption that the fibers in the central zone of the nip line move into the core of the yarn whereas the fibers outside this "core zone" form the wrap fibers. A method based on this theory is found, for example, in U.S. Pat. No. 4,598,537 in which air streams on the input side of the delivery roller pair are used to produce edge fibers.

This simple approach may be satisfactory for the spinning of relatively rough yarns but is not applicable to the spinning of relatively fine yarns. As can be gathered from EP 131,170, wrap fibers can arise both from the "core zone" of the spinning triangle and from the edge zones. It has even been found that the wrap fibers originating from the core zone engage the yarn core better than edge fibers and are therefore better able to increase yarn strength. The production of wrap fibers in the center of the spinning triangle should therefore be boosted in every way.

Accordingly, it is an object of the invention to promote the origination of wrap fibers in every zone of the spinning triangle.

It is another object of the invention to improve the quality of a false twist yarn.

It is another object of the invention to improve the jet spinning of a yarn.

In a drafting arrangement according to this invention, the delivery roller pair is devised and/or operated to deflect fibers away from the plane of conveyance. The plane of conveyance is a plane containing a rectilinear prolongation of the main fiber flow issuing from the delivery roller pair.

In a preferred variant, the delivery roller pair comprises a first roller of metal and a second roller made of a relatively resilient material. The two rollers engage one another to form a nip line of a predetermined length. The length of such a nip line is determined by the axial length of the resilient roller. The engaging surfaces of the rollers are continuous cylinder surfaces, i.e., surfaces devoid of incisions or recesses or other interruptions. More particularly, these engaging envelope surfaces of the rollers are not interrupted by air flow passages (as in U.S. Pat. No. 4,718,225 and/or U.S. Pat. No. 3,487,619) or fluting (e.g. according to U.S. Pat. No. 2,199,842) or by fiber-guiding incisions (e.g. according to U.S. Pat. Nos. 3,090,081 and/or 3,296,664). Surfaces of this kind will be referred to hereinafter as "smooth" surfaces.

The resilient material of the second roller preferably has a Shore hardness of from 60 to 70, a Shore hardness of approximately 65 being preferred. This material can be made of rubber or of a synthetic material (elastomer). The axial length of this roller, such length determining the length of the nip line, can be between 28 and 32 millimeters (mm) and is preferably 30 millimeters (mm).

The second roller can be a smooth metal roller but would not than provide the same deflecting effect. However, the hardness of the material can be compensated for to some extent by increasing the pressure pressing the rollers together.

The drafting arrangement is constructed for use in a false twist spinning machine having a relatively high delivery speed (more than 150 m/min.). The drive of the delivery roller pair must be devised correspondingly and drive systems of this kind are already known.

In operation, a drafting arrangement of this kind should so co-operate with a suction nozzle that the nozzle intakes the wrap fibers delivered by the arrangement and guides them to the false twisted yarn core. The nozzle itself can produce the false twist in the yarn core or can co-operate with another false twist element such as another nozzle or a mechanical twister.

The suction nozzle is so disposed relative to the drafting arrangement and produces such an air stream (for example, an air stream having such a high speed) as to deflect back to the main fiber flow as wrap fibers the fibers previously deflected by the delivery roller pair.

These and other objects and advantages of the invention will become more apparent from the following detailed description taken in conjunction with the accompanying drawings wherein:

FIG. 1 illustrates a side view of a drafting arrangement in accordance with the invention;

FIG. 2 illustrates a plan view of the delivery roller pair of the arrangement of FIG. 1;

Figure 3A:
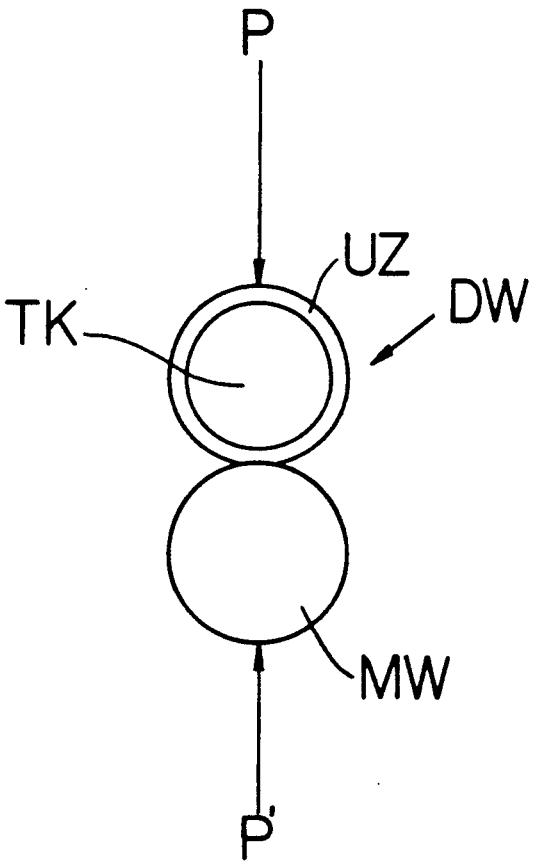
FIG. 3 illustrates an isometric view of the delivery roller pair of FIG. 1.

FIG. 3*a* illustrates a cross sectional view of the delivery roller pair of FIG. 3;

FIG. 4 illustrates a side view of the delivery roller pair in combination with a first variant of a suction nozzle arrangement in accordance with the invention; and FIG. 5 illustrates a side view of the delivery roller pair in combination with a second variant of a suction nozzle arrangement in accordance with the invention.

Referring to FIG. 1, the drafting arrangement comprises a feed roller pair EP, a middle roller pair MP and a delivery roller pair LP. Each such pair comprises a first driven roller made of metal (e.g. driven by a suitable drive means D at a high speed) and a second roller (pressing roller) made of rubber. Each pressing roller DW is pressed by a carrier system (not shown) against its associated metal roller MW so that the rollers of the delivery roller pair LP contact one another along a nip line KL (FIGS. 2 and 3). The arrangements of the feed roller pair are the same. The rollers of the middle roller pair MP each carry an apron R1, R2 in order to improve fiber guidance in the main drafting zone between the middle roller MP and the delivery roller pair LP. This arrangement is known and will therefore not be described in greater detail herein.

Instead of the double apron guidance shown, the drafting arrangement could be a so-called KEPA draft arrangement, for example, of the kind according to U.S. patent application Ser. No. 07/377,541, filed July 10, 1989. The preliminary drafting zone between the feed roller pair EP and the middle roller pair MP can be devised with or without a pressure rod in accordance with U.S. patent application Ser. No. 07/401,621, filed Aug. 31, 1989. The arrangement is not limited to the 2-zone drafting arrangement shown but can be used in drafting arrangements having three or more drafting zones. The metal roller of the feed roller pair EP can be fluted or smooth, for example according to U.S. Pat. No. 2,244,461 or U.S. Pat. No. 2,199,842.

The following description relates to the construction and operation of the delivery roller pair LP and concentrates on that pair and the elements disposed thereafter. However, an overall arrangement as shown in FIG. 1 is assumed, so that the fiber flow from the drafting arrangement flows from left to right in all the drawings and correspondingly each metal roller MW rotates clockwise about its own axis and each pressing roller DW rotates anticlockwise about its own longitudinal axis.

In high-draft arrangements for jet spinning, the output speed may be relatively high, for example, up to 300 m/min (by way of comparison, the drafting arrangement of a conventional ring spinning machine has an output speed of up to about 25 m/min). As diagrammatically illustrated, the fiber material flows through the drafting arrangement in the form of a fiber flow FS. This flow is disposed in a plane determined by the nip lines of the roller pairs and the flow leaves the front roller pair in the same plane.

The high speed produces air flows LS1 (FIG. 1) on the input side of the front roller pair LP which stick to the surfaces of the rollers, converge in the nip and then flow along the nip line KL from the central zone towards both the end zones of the nip line KL (FIG. 2). On the output side of the delivery roller pair, however, air flows LS2 (FIG. 2) flow from both the end zones towards the center of the nip line where they are entrained by the roller surface (FIG. 1). The air passages of U.S. Pat. No. 4,718,225 and U.S. Pat. No. 3,487,619 and the "screening effects" of the aprons R1, R2 of EP Patent 107,828 are prior attempts to reduce the disturbing effects of such air flows.

No such air passages are present in the front roller pair according to FIG. 1. On the contrary, the engaging envelope surfaces MF (FIG. 3) of the pressing roller DW and metal roller MWS of the delivery roller pair LP are both continuous (uninterrupted) cylindrical surfaces of an axial length L which corresponds to the axial length of the pressing roller DW. The axial length of the metal roller of this roller pair can either be the same as the length L of the pressing roller DW (shown in chain lines in FIG. 3) or be longer than such axial length, as indicated by solid lines in FIGS. 3. In the latter case, the metal roller MW can either be associated with a single spinning position of the spinning machine (not shown) or can extend over a number of such positions (in any case over one whole side of the machine).

The metal roller MW is normally made of steel and can, in the zone contacting the pressing roller DW, be polished according to U.S. Pat. No. 2,199,842 or in accordance With U.S. Pat. No. 2,244,461 sandblasted or plasma coated or treated in some other way.

The pressing roller DW comprises a carrying member TK (shown diagrammatically only in FIG. 3) and, disposed thereon, a cover, coating or the like UZ of rubber or some other synthetic elastomeric material. This clothing has a Shore hardness in the region of 60 to 70 and preferably of approximately 65. The length L of the pressing roller DW is from 28 to 32 mm, preferably 30 mm.

Referring to FIG. 3*a* wherein like reference characters indicate like part as above, suitable means, as schematically indicated by the arrows P, P', are provided for pressing the rollers DW, MW together with at least one roller being slightly deformed at the nip line.

This construction of the rollers of the delivery roller pair LP boosts air flows LS1, LS2 in the peripheral directions of both the delivery rollers as a result of the rotation thereof. The air flows LS1 (FIG. 2) spread fibers away from the sliver edges, something which promotes the formation of the "edge fibers" previously referred to. Such edge fibers are useful for false twist spinning but are not the main object of this construction.

The construction of the rollers of the delivery roller pair LP so acts on the fibers delivered by the drafting arrangement that the number of fibers deflected in the peripheral directions of the delivery rollers even inside the actual spinning triangle is reduced in proportion to the total quantity of fibers.

This effect is due partly to the air flows LS2 of FIG. 2, which are boosted by the "smoothness" of the rollers.

The effect just mentioned is also produced by adhesion between the fibers and the delivery rollers. This adhesion is enhanced if a relatively soft material is used for the roller coating. The adhesion can also be boosted by a relatively high pressure acting on the pressing roller. This pressure can be so chosen in relationship to clothing hardness that the coating of the harder lower roller deforms readily, something which enhances the required effect. The same effect could even be produced between two metal rollers if the pressure applied to them was very high.

Thus, during rotations of the delivery roller pair LP, the air flows LS1 on the input side converge in the nip to flow from a central zone thereof towards opposite end zones thereof in order to spread the fibers outwardly. On the other hand, the air flows LS2 on the output side flow from the end zones toward the central zone of the nip.

These effects are most undesirable in conventional spinning since deflected fibers lead to a hairy yarn or are even lost as fly; even worse, fibers sticking to the rollers might form a coil around the pressing roller DW or metal roller MW. In a false spinning process in which a suction nozzle is associated with the delivery roller pair, the suction nozzle itself acts to obviate these undesirable effects, as will be described in greater detail with reference to FIGS. 4 and 5.

FIG. 4 shows the delivery roller pair LP in combination with a single spinning nozzle SD of a false twist spinning device, for example, in accordance with EP 121,602 or DE Patent 3,301,652. A nozzle of this kind is formed with an opening M which is relatively wide in the peripheral direction of the rollers DW and MW and intakes air A from the atmosphere through the opening M. A fiber deflected by the air flows LS2 (FIG. 1) or by sticking is therefore further deflected by the opposite air flows A and guided back into the passage K of the nozzle SD. This fiber is therefore brought into engagement with the yarn core (not shown) and wrapped therearound. Since this procedure is known, it will not be described herein in greater detail.

A three-dimensional (3-D) production of wrap fibers is thus made possible, in contrast to a two-dimensional production (U.S. Pat. No. 4,598,537) resulting from the use just of the "edge fibers". The reason for this advantageous "3-D" effect is that various properties of a delivery roller pair which are normally considered undesirable are combined to produce advantageous fiber movements and are used in combination with a subsequent suction system.

FIG. 5 shows the delivery roller pair LP again in combination with a suction nozzle D; however, the nozzle D acts not solely as a spinning jet but also prepares the fibers for a further false twist element (not shown). A nozzle of this kind is known from U.S. Pat. No. 4,457,130 and DE Patent 3,437,343. Although the nozzle D is devoid of any orifice which is wide in the peripheral directions of the rollers, the nozzle D produces air flows A by suction which oppose the air flows LS2 of FIG. 1 and the sticking of the fibers and reintroduces the deflected fibers back into the suction passage SK of the nozzle D.

In both cases, the air flows LS2 and the adhesion of the fibers (FIG. 1) so act that additional fibers are released from the yarn core, then subsequently reengaged therewith as wrap fibers. The fibers can originate both from the edge zones at the outer ends of the nip line and in the central zone thereof, the latter fibers being particularly desirable and has already been explained in the introductory part of this description. The arrangement is very advantageous for jet spinning of relatively rough yarns since it is particularly difficult to produce an adequate number of wrap fibers with such yarns.

As already stated, the arrangement is not limited to details of the constructions shown. Where double apron guiding is used, one apron (the apron R2 of FIG. 1) can extend closer to the delivery roller pair LP than the other apron (the apron R1 of FIG. 1). An arrangement of this kind has been dealt with both in U.S. Pat. No. 4,718,225 and EP Patent 107,828. The arrangement can also be used in association with conventional apron guiding, for example, in accordance with U.S. Pat. No. 3,296,664. Preferably, the aprons R1, R2 are considerably wider than the fiber flow passing between the aprons, so that the movement of the driven apron (the apron R2 in FIG. 1) is transmitted by contacts between the aprons themselves to the top apron (the apron R2 in FIG. 1). An apron width of more than 35 mm preferably approximately 40 mm, is advantageous.

To ensure that the nip force is adequate although the rollers are smooth, the smooth rollers preferably have some surface roughness which can be produced, for example, by hard chromium plating, plasma coating or similar processes. This roughness must in no case permit the passage of air (of the conventional knurling) but can give the surfaces an orange-peel texture.

It has surprisingly been found that the pressure or hardness of the pressing roller of the delivery roller pair has an effect on spinning tension after the nozzle. The spinning tension for a given spinning speed can be increased by increasing the pressure or using a softer pressing roller. This leads to an increased spinning speed for a given strength since yarn strength is so dependent from spinning tension that maximum strength is produced at a particular spinning tension and the same decreases with increasing spinning speed. Apparently, the increase in the number of wrap fibers produces increased friction thereof at the nozzle entry, so that the draw-off system has to produce an increased draw-off force and therefore an increased spinning tension. However, the arrangement is not limited to this explanation of the phenomenon.

It is proposed to adapt the pressure and the hardness of the pressing roller to one another. At a pressing roller hardness of approximately 68 Shore, a pressure (on the latter roller) of 6 to 10 kg has been found advantageous. On the other hand, at a Shore hardness of 83, a pressure of 10 to 15 kg has been found advantageous.

The invention thus provides a method and apparatus of producing yarn of improved quality in a false twist spinning machine.

What is claimed is:

1. In a drafting arrangement for a false twist spinning machine a delivery roller pair defining a nip line therebetween for passage of a flow of fiber material therethrough, each said roller of said delivery roller pair having a continuous uninterrupted cylindrical surface; and drive means for driving said roller pair at a delivery speed of more than 150 meters per minutes whereby said speed of said rollers produce air flows which converge on an input side of said rollers towards said nip line to flow from a central zone of said nip line towards opposite end zones thereof to spread fibers at the edge of said fiber material flow outwardly while said air flows flow from said end zones on an output side of said rollers towards said central zone of said nip line.

2. A drafting arrangement as set forth in claim 1 wherein one of said roller pair has a cylindrical surface softer than the cylindrical surface of the other roller.

3. A drafting arrangement as set forth in claim 2 wherein said cylindrical surface of said one roller has a coating of rubber thereon.

4. A drafting arrangement as set forth in claim 3 wherein said rubber coating has a Shore hardness of from 64 to 68.

5. A drafting arrangement as set forth in claim 2 wherein said one roller has a coating of synthetic elastomer thereon.

6. A drafting arrangement as set forth in claim 1 wherein said rollers are pressed together with at least one roller being slightly deformed at said nip line.

7. A drafting arrangement as set forth in claim 1 wherein said nip line has an axial length of from 28 to 32 millimeters.

8. A drafting arrangement as set forth in claim 1 further comprising a feed roller pair for delivering a flow of fiber therebetween, a middle roller pair between said feed roller pair and said delivery roller pair for drafting the flow of fiber and a pair of aprons for conveying the fiber flow therebetween, each apron being disposed about a respective roller of said middle roller pair.

9. A drafting arrangement as set forth in claim 1 wherein one of said roller pair is made of metal and the other of said roller pair has a surface of softer material and is pressed against said one roller of said roller pair.

10. In combination a delivery roller pair of a drafting arrangement, said roller pair defining a nip line for passage of a flow of fiber material therebetween, each said roller of said roller pair having a cylindrical surface;

drive means for driving said roller pair at a delivery speed of more than 150 meters per minute whereby during rotation thereof air flows on an input side converge in said nip line to flow from a central zone thereof towards opposite end zones thereof to spread fibers outwardly in said nip line while air flows on an output side flow from said end zones towards said central zone; and a suction nozzle of a false twist spinning device, said suction nozzle being aligned with said nip line to draw the flow of fiber material thereinto.

11. The combination as set forth in claim 10 wherein said suction nozzle produces air flows to redeflect fibers deflected by said rollers in a peripheral direction into a suction chamber within said nozzle.

12. A method of false twist spinning of fiber material, said method comprising the steps of directing a flow of fiber material into a nip line between a pair of delivery rollers; and rotating said rollers at a high speed to deliver the fiber material at a delivery speed of more than 150 meters per minute while producing air flows to deflect fibers of the fiber material in the nip line from a central zone of the nip line towards opposite end zones and to re-deflect the fibers downstream of the rollers towards said central zone for wrapping as wrap fibers about a yarn core.

13. A method as set forth in claim 12 which further comprises the step of drawing the fiber material into a suction nozzle downstream of the delivery roller pair.

* * * * *

UNITED STATES PATENT AND TRADEMARK OFFICE

CERTIFICATE OF CORRECTION

PATENT NO. : 5,038,553

DATED : August 13, 1991

INVENTOR(S) : HERBERT STALDER
EMIL BRINER

It is certified that error appears in the above-identified patent and that said Letters Patent is hereby corrected as shown below:

Column 4, line 50 change "part" to -parts-
Column 6, line 39 change "from" to -on-
Column 6, line 66 change "minutes" to -minute-
Column 6, line 67 change "produce" to -produces- Signed and Sealed this Twentieth Day of July, 1993

*Attest:*

*Attesting Officer*

Michael K. Kirk

MICHAEL K. KIRK

*Acting Commissioner of Patents and Trademarks*